US005707104A

United States Patent [19]

Perego

[11] Patent Number: 5,707,104

[45] Date of Patent: Jan. 13, 1998

[54] HIGHCHAIR WITH IMPROVED CLOSING MECHANISM

[75] Inventor: Gianluca Perego, Arcore, Italy

[73] Assignee: Peg Perego Pines, S.p.A., Arcore, Italy

[21] Appl. No.: 680,608

[22] Filed: Jul. 16, 1996

[30] Foreign Application Priority Data

Jul. 25, 1995 [IT] Italy ..... MI95 A 001603

[51] Int. Cl.[6] ..... A47C 4/00; A47D 1/02

[52] U.S. Cl. ..... 297/16.1; 297/24; 297/463.1

[58] Field of Search ..... 297/16.1, 24, 25, 297/463.1; 280/650, 642, 658, 647, 649

[56] References Cited

U.S. PATENT DOCUMENTS

| | | | |
|---|---|---|---|
| Re. 30,867 | 2/1982 | Gaffney | 280/642 |
| 4,527,665 | 7/1985 | Shamie | 280/650 |
| 4,741,551 | 5/1988 | Perego | 280/658 |
| 4,958,885 | 9/1990 | Kassai | 297/16.1 |
| 5,165,755 | 11/1992 | Rho | 297/25 |
| 5,460,399 | 10/1995 | Baechler et al. | 280/650 |
| 5,538,011 | 7/1996 | Craft et al. | 297/25 |

*Primary Examiner*—Peter M. Cuomo
*Assistant Examiner*—Anthony D. Barfield
*Attorney, Agent, or Firm*—McGlew and Tuttle

[57] ABSTRACT

A folding highchair including a seat and a supporting frame supporting the seat. The frame includes legs which are movable caliper-fashion between an open position and a closed position. A pedal is disposed close to a lower end of the legs to operate the release of structure for holding the legs in the open position, so as to enable the movement of the legs towards the closed position upon lowering the pedal.

13 Claims, 4 Drawing Sheets

HIGHCHAIR WITH IMPROVED CLOSING MECHANISM

FIELD OF THE INVENTION

This invention refers to a highchair with an innovative closing mechanism, which makes the highchair more practical to close, as compared to the mechanisms proposed in the known technique.

BACKGROUND OF THE INVENTION

The main problems in designing foldable highchairs are basically being able to reduce the overall dimensions of the highchair in the closed position and ensure that the highchair absolutely cannot fold up accidentally, for example due to a wrong movement or a locking mechanism not properly engaged. In particular, the requirement to satisfy the indispensable need to prevent unintentional folding complicates the closing movement and the various stop mechanisms, making the voluntary folding movements relatively complicated and inconvenient.

In the known technique, numerous closing mechanisms have been proposed. For example, highchairs with pairs of legs which close caliper-fashion and with locking toggles disposed laterally between the legs have been proposed. Even though the mechanism made in this way is undoubtedly safe, to the point of being adopted by practically all highchair manufacturers, it is somewhat inconvenient to use, since it is necessary to simultaneously unlock both toggles on the opposing sides of the highchair. The problem of designing a folding highchair with satisfactory features is further complicated if the highchair is to be provided with good means of adjustment, for example seat height adjustment.

SUMMARY OF THE INVENTION

The primary object of this invention is to obviate the aforementioned problems, by providing a folding highchair which is extremely easy to open and close while at the same time being absolutely safe to use, and also having extremely small overall dimensions in the closed position and a high degree of adjustability in the position of the seat.

This scope is achieved, according to the invention, by providing a folding highchair comprising a seat and a supporting frame for supporting the seat, the frame comprising legs which are movable caliper-fashion between an open position and a closed position, releasable locking means being provided to maintain the legs in the open position, characterized by the fact of comprising pedal means disposed close to one lower end of the legs, when operated the pedal means acting upon the locking means to release them, in order to enable the movement of the legs towards the closed position.

BRIEF DESCRIPTION OF THE DRAWINGS

The innovative principles of this invention and its advantages with respect to the known technique will be more clearly evident from the following description of a possible exemplificative embodiment applying such principles, with reference to the accompanying drawings, in which.

DETAILED DESCRIPTION OF THE INVENTION

Figure 1:
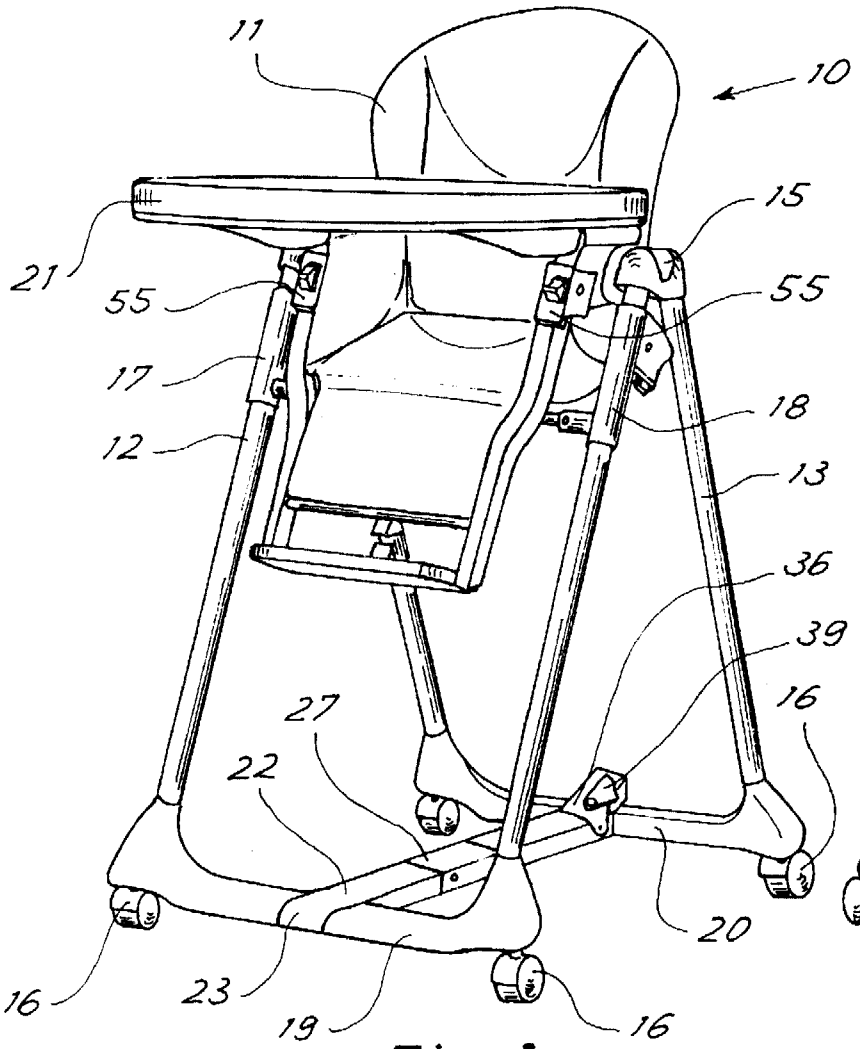
FIG. 1 shows a perspective view of a highchair according to the invention, in a first position of use or position with the seat completely raised.

With reference to the figures, FIG. 1 shows a highchair, generically indicated by reference 10, in a first open position with the seat 11 (if necessary provided with a tip-up tray 21) completely raised. The highchair has a frame which comprises a pair of U-shaped legs 12, 13, hinged from above in correspondence with caliper elements or means 14, 15, to enable them to be opened and closed caliper-fashion. The legs can comprise wheels 16 resting upon the ground.

Each leg 12, 13 can be made with a pair of lateral uprights, for example made of tubular metal, joined from below by a horizontal element 19, 20. Advantageously, the seat 11 is supported on the front leg 12 alone by means of a pair of lateral supports 17, 18, which can be made to slide along the lateral uprights of the leg 12, as will be explained further on, to shift the seat 11 from the completely raised position, shown in FIG. 1, to the completely lowered position, shown in FIG. 2, if required, with several intermediate stable positions.

Locking means 22 normally maintain the legs in the open position. A pedal 36 enables the user to release the locking means to allow the highchair to be folded by bringing the legs close together.

The locking means can be made by means of an articulated crosspiece 22, hinged between the horizontal elements 19 and 20 of the legs.

Figure 2:
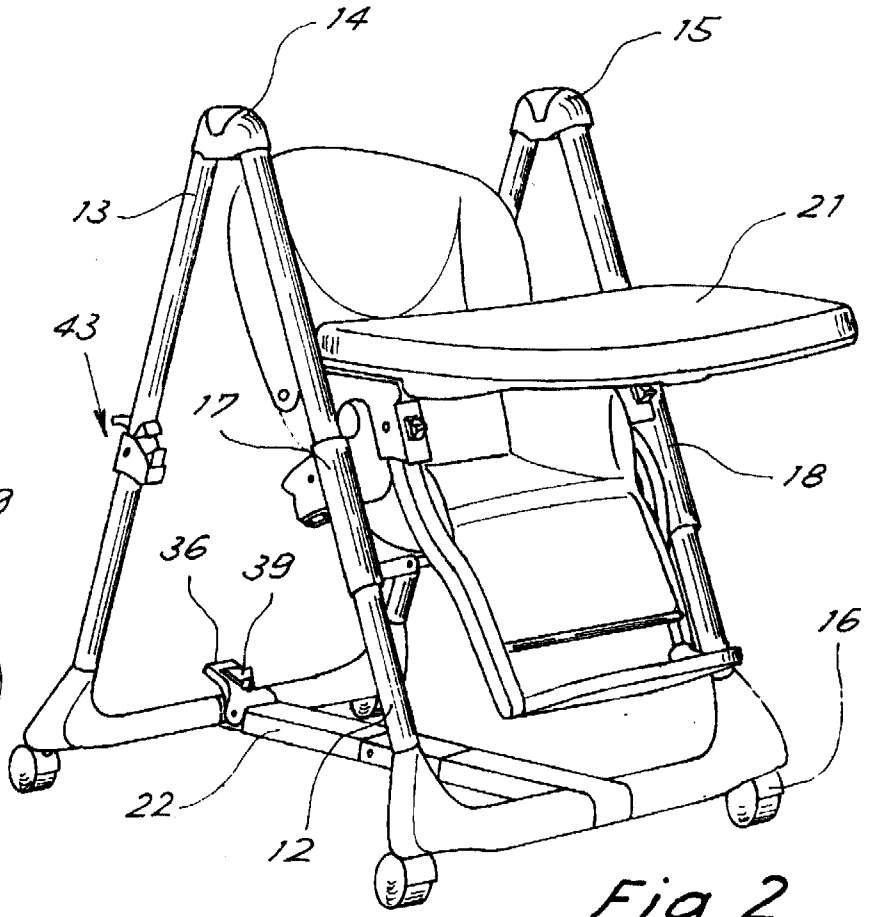
FIG. 2 shows a perspective view of the highchair in a second position of use, or position with the seat completely lowered.
Figure 4:
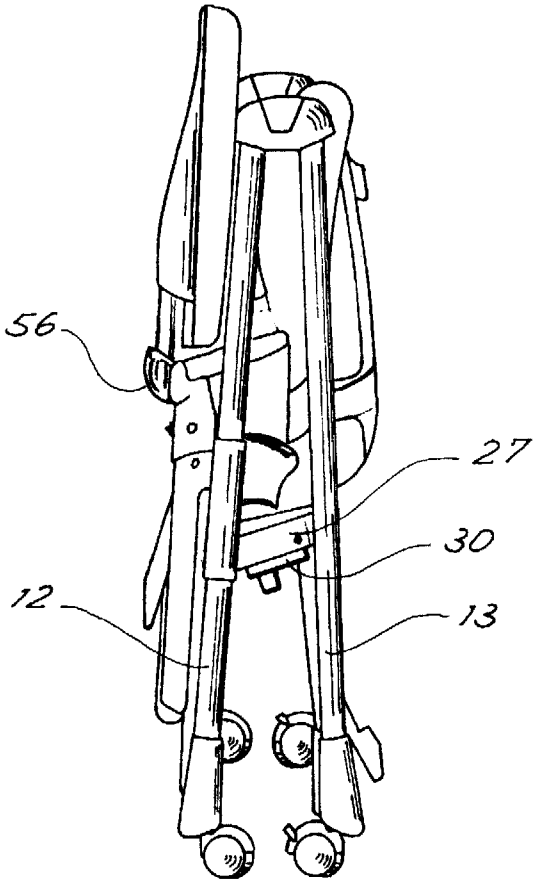
FIG. 4 shows a side view of the highchair in a fully closed position.
Figure 3:
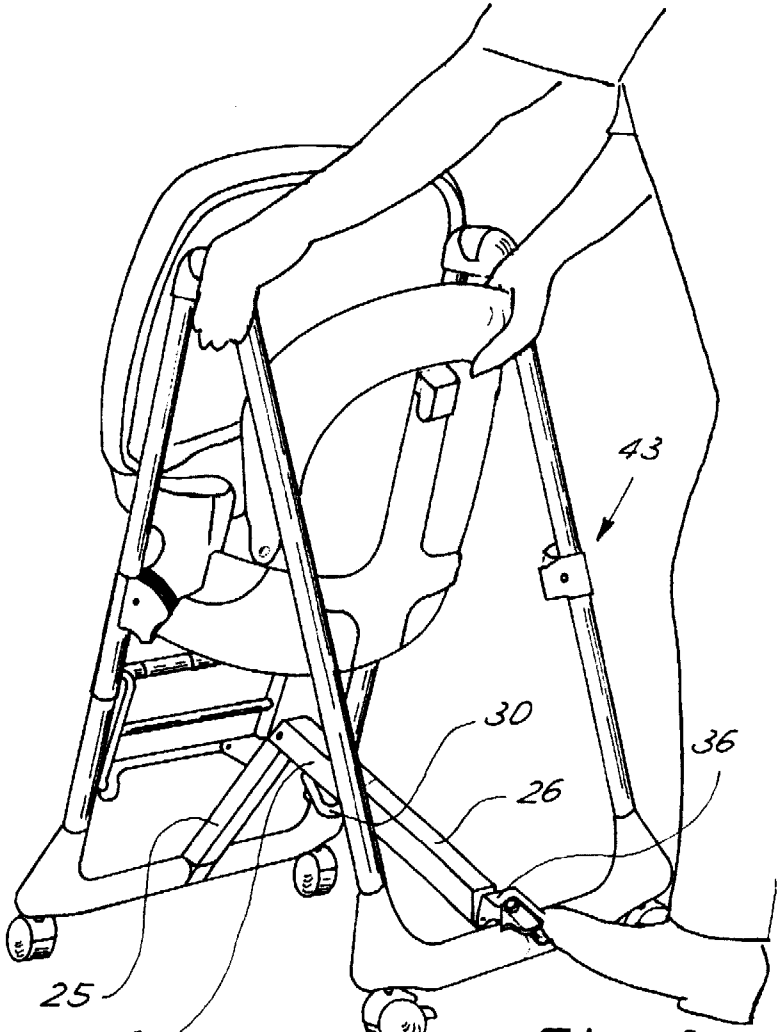
FIG. 3 shows a rear perspective view of the highchair during the closing operation.

As can be clearly seen in FIG. 3, the locking crosspiece 22 is divided in an intermediate position to form two semi-crosspieces 25, 26, hinged together by means of an articulated joint element 27. When the highchair is open the articulated joint 27 is locked, so as to maintain the crosspiece rigid, with the two semi-crosspieces aligned with each other (FIGS. 1 and 2). As can be clearly seen in FIG. 3, disposed close to the rear end of the crosspiece is a release pedal 36, whose operation causes the release of the articulated joint and enables the highchair to be folded up. The pedal is positioned in such a way as to render the highchair easily foldable with one simple movement. In fact, it is sufficient to stand behind the highchair, press the pedal with one foot and simultaneously lift the hinged ends of the legs, as can also be clearly seen in FIG. 3. The fact that the seat is secured just to the front leg renders the operation particularly easy and relatively effortless. If it is required for the highchair to have the minimum overall dimensions in the folded position, Before carrying out the folding movement it is necessary to shift the seat to the lowest position and tip the tray 21 upwards. The highchair thus takes on the appearance shown in FIG. 4.

Figure 5:
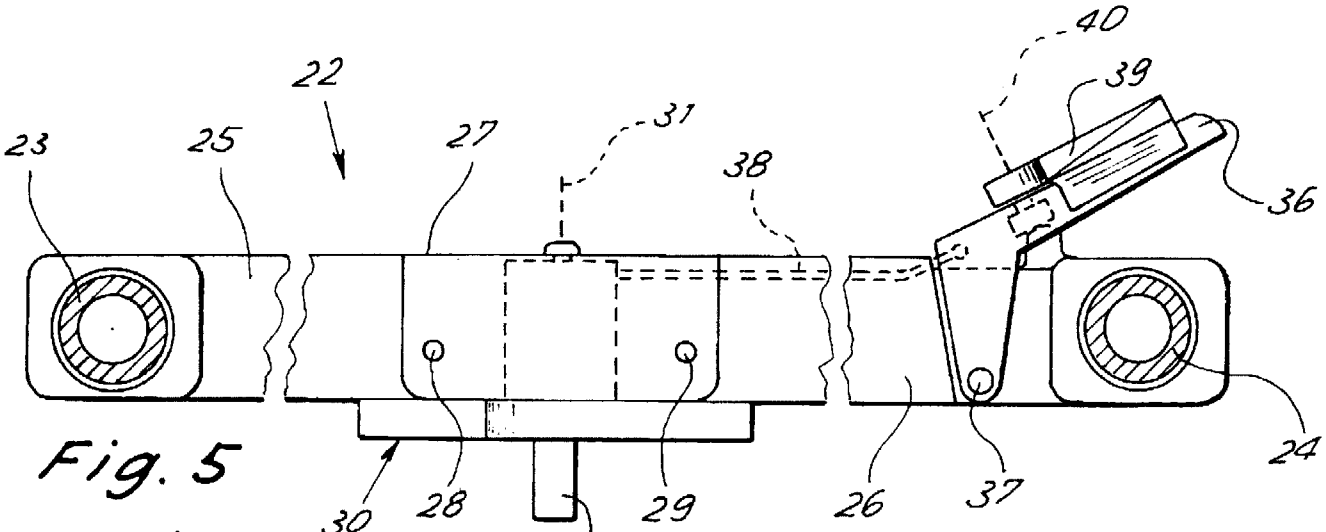
FIGS. 5 and 6 show, respectively, partial schematic side and top views of a portion of the highchair closing mechanism of the previous figures.

FIG. 5 shows the pedal-operated mechanism for locking and releasing the central articulated joint of the crosspiece. The articulated joint element 27 has hinge pins 28, 29 for hinging the semi-crosspieces 25, 26, so as to enable only the upward hinging movement shown in FIG. 3. The element 27 inferiorly supports stiffening means, made in the form of a lock bolt 30 which is rotatably pivoted according to a vertical axis 31. As can also be clearly seen in FIG. 6, the bolt 30 has arms 32, 33, which extend so as to interfere with the semi-crosspieces and prevent their reciprocal hinging movement when the bolt is disposed in a locking position substantially parallel to the length of the crosspiece. The bolt 30 is held in the locking position by means of a spring 34. The pedal 36 is hinged to the semi-crosspiece 26 according to a horizontal axis 37 and is connected to the bolt 30 by means of a tension wire 38, for example a metal cable. Upon lowering the pedal, the tension wire 38 turns the bolt, against the action of the spring 34 to shift it to the position 30' shown by the chain line in FIG. 6. In this position, the ends 32, 33 of the bolt no longer interfere with the semi-crosspieces, thereby allowing their reciprocal folding movement.

The bolt 30 has a central finger 35 which protrudes from below to position itself close to the floor when the highchair is in the open position. The finger 35 acts as a limiting device for limiting the downward flexure of the crosspiece (flexure which could be caused, for example, by accidental loads applied to the crosspiece), thereby preventing excessive stress on the articulated joint 27. To ensure against accidental operation of the pedal 36, the pedal itself is advantageously provided with a locking lever or enabling element 39, pivoted by 40 to the pedal to rotate in the plane of the pedal against the action of a spring (not shown).

Figure 6:
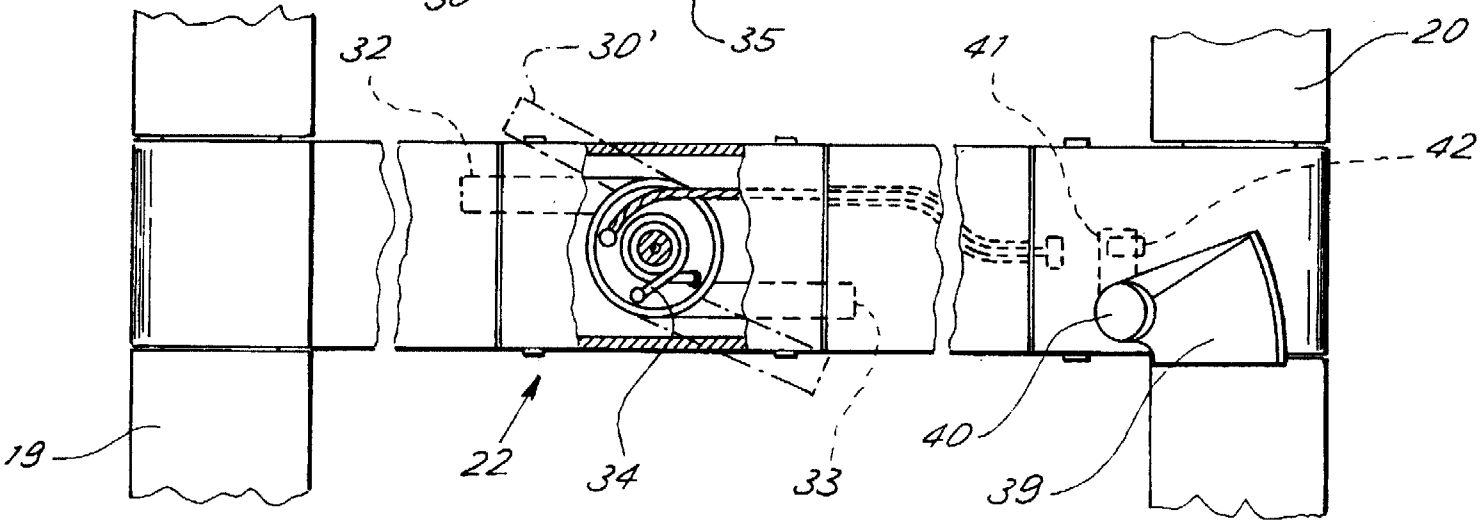

In its stable position, the locking lever extends over the pedal, as shown in FIG. 6, and a locking finger 41, integral with the lever, rests upon a protrusion 42 which rises from the semi-crosspiece 26 beneath the pedal 36. Interference between the finger 41 and the protrusion 42 thus prevents the pedal from being pressed down.

To operate the pedal, simply rest the foot on the pedal while simultaneously rotating the locking lever towards the left with the side of the foot, as shown in FIG. 3, so as to shift the finger 41 to the side of the protrusion 42 and free the movement of the pedal.

Figure 7:
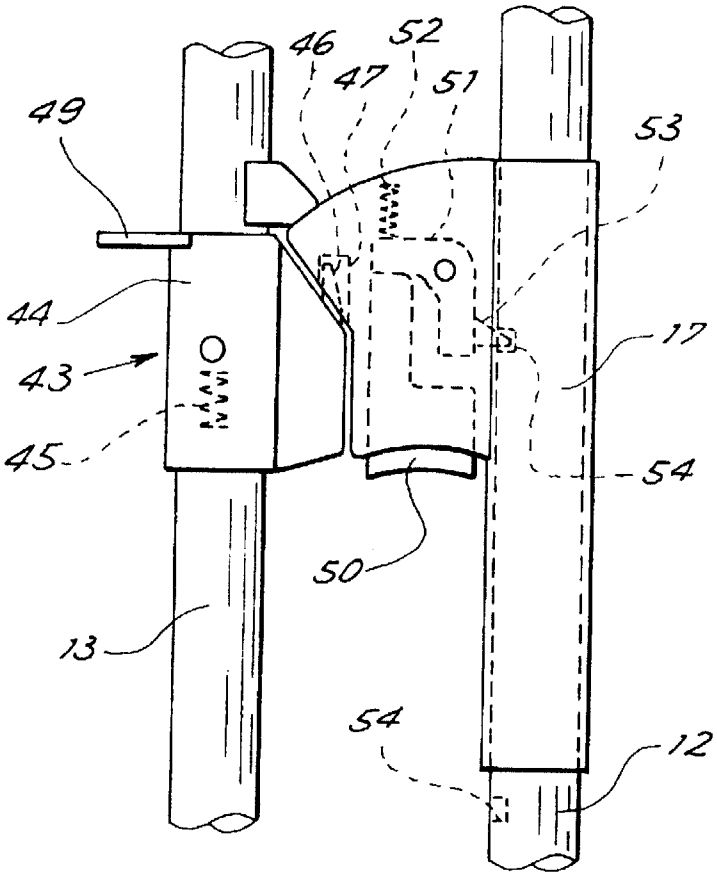
FIG. 7 shows a schematic view of a locking device for locking the highchair in the closed position.

FIG. 7 shows a device 43 for locking the highchair in the closed position. This device comprises a cursor 44 that slides up one leg of the highchair against the action of a spring 45. The cursor has a tooth 46 which fits into a housing made in an element disposed on the other leg of the highchair. When the highchair is folded up, the tooth 46 snaps elastically into the housing, preventing the legs from being pulled apart. An operating tab 49 enables the cursor to be lowered against the action of the spring 45, to release the tooth 46 from the housing 47 in order to unfold the highchair.

FIG. 7 also schematically shows the operating mechanism of the lockable cursor 17 for adjusting the height of the armchair. The cursor 18, being identical, is not shown in detail.

The cursor comprises a release button 50, which moves a lever 51, against the action of a spring 52, so as to disengage a tooth 53 from one slot 54 of a plurality of slots 54 disposed at regular intervals on the leg along which the cursor slides. To adjust the height of the seat, simply grip a cursor 17, 18 in each hand and press the buttons 50, slide the seat into the desired position and release the button so that the teeth 53 engage in a new slot 54.

As can also be seen in FIG. 7, the casing of the cursor 17 comprising the locking mechanism advantageously also acts as a coupling element for the tooth 46. In this way, suitably choosing the position of the cursor 43 along the leg ensures that the seat is shifted to the lower position before the highchair is folded up.

Figure 8:
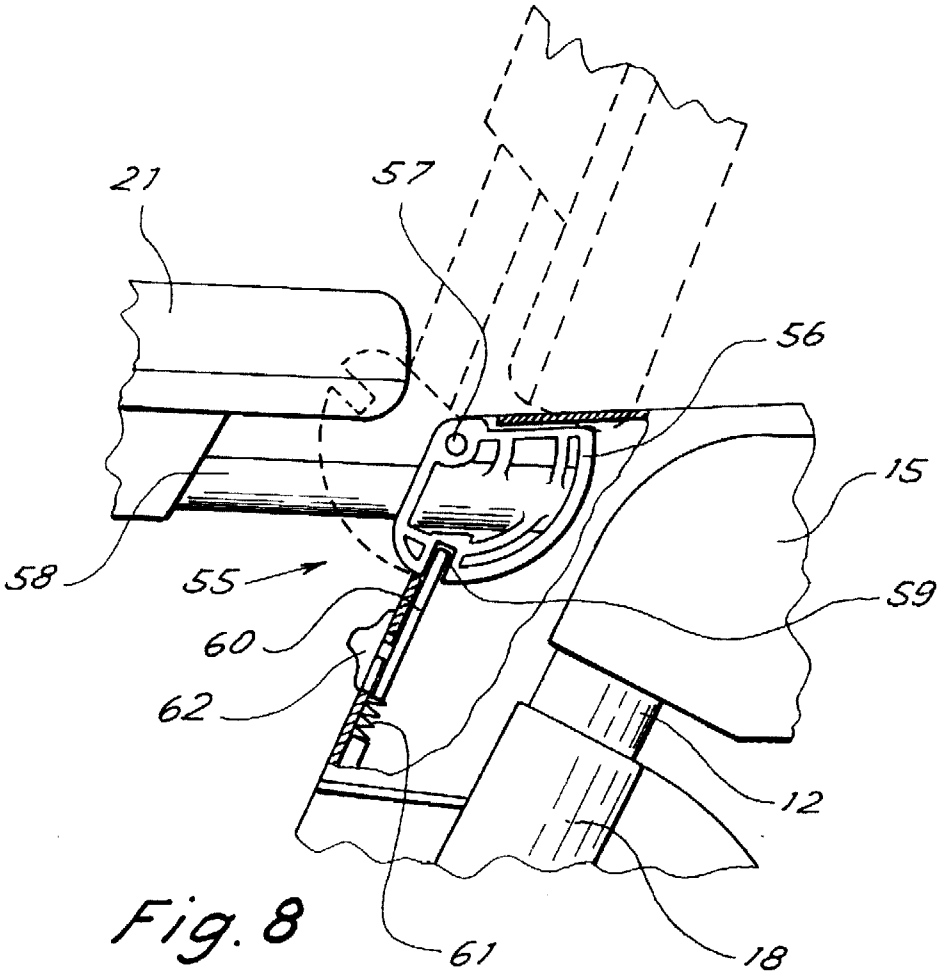
FIG. 8 shows a schematic view of a mechanism for tipping up the tray of the highchair.

FIG. 8 shows a possible mechanism 55 for the tip-up movement of the tray 21. The mechanisms 55 are two in number, one on either side of the tray, as can be clearly seen in FIG. 1, and comprise a hinge element 56, pivoted by 57 into the armrest of the seat to support one end of a tube 58 supporting the tray. The hinge element 56 has a slot 59 into which fits a cursor 60 biased by a spring 61. The cursor has an externally protruding button 62 which can be operated manually to release the cursor from the slot 59 so as to allow the tray to be shifted towards the raised position, shown by the broken line in FIG. 8. At this point it will be clear that the intended scopes have been achieved by providing an adjustable highchair having a reliable opening and closing mechanism, which is extremely easy to operate.

The foregoing description of an embodiment applying the innovative principles of this invention is obviously given by way of example in order to illustrate such innovative principles and should not therefore be understood as a limitation to the sphere of the invention claimed herein. For example, the conformation of the seat can vary according to particular practical or aesthetical requirements.

Moreover, the pedal means can also act to disengage the crosspiece in a position different from a central position forming two semi-crosspieces.

What is claimed is:

1. A folding highchair comprising:

a seat;

a frame connected to said seat and supporting said seat, said frame including first and second legs, said first and second legs each including first and second opposite ends, said frame also including caliper means for rotatably joining said first ends of said first and second legs and holding said first and second legs angularly movable between a closed position with said first and second legs adjacent each other and an open position with said first and second legs being angularly spaced;

locking means for releasably locking said first and second legs in said open position, said locking means including an articulated crosspiece hinged to each of said second ends of said legs, said locking means also including stiffening means for stiffening said articulated crosspiece and blocking rotation of said crosspiece, said stiffening means including a bolt movable into a locked position where said bolt blocks rotation of said articulated crosspiece for locking said legs, said bolt also being movable into an unlocked position for rotation of said articulated crosspiece and angular movement of said legs;

pedal means positioned adjacent said second ends, said pedal means being operatable by an operator to release said locking means and enable said first and second legs to be angularly movable together, said pedal means being connected to said bolt and operation of said pedal means moving said bolt from said locked position to said unlocked position.

2. A highchair in accordance with claim 1, wherein:

said articulated crosspiece includes a rotatable joint element;

said bolt is rotatably movable between said locked and unlocked position to respectively block and enable rotation of said joint element.

3. A highchair in accordance with claim 1, wherein:

said pedal means is longitudinally adjacent said second ends of said first and second legs.

4. A highchair in accordance with claim 1, wherein:

said pedal means is operatable by a foot of the operator.

5. A highchair in accordance with claim 1, wherein:

said pedal means includes an enabling element for enabling and disabling said pedal means.

6. A highchair in accordance with claim 1, wherein:

said pedal means includes a pedal, movement of said pedal deactivating said locking means, said pedal means includes an enabling element movable in a direction substantially perpendicular to said movement of said pedal for selectively blocking and enabling movement of said pedal.

7. A highchair in accordance with claim 1, wherein:

said first leg includes a pair of uprights defining a plurality of slots;

said seat includes a pair of cursors slidingly supporting said seat on said uprights, said cursors including engaging means for engaging with said slots, said engaging means including button means for controlled disengagement and free sliding of said seat.

8. A highchair in accordance with claim 7, wherein:

said second leg includes a pair of uprights;

said seat is positioned between said uprights in said closed position of said legs.

9. A highchair in accordance with claim 1, further comprising:

coupling means for locking said first and second legs in said closed position.

10. A highchair in accordance with claim 1, further comprising;

a tip-up tray connected to said seat.

11. A highchair in accordance with claim 10, wherein:

said tray is rotatably connected to said seat, said tray includes tray locking means for locking said tray to said seat.

12. A highchair in accordance with claim 10, wherein:

said tray is rotatably connected to said seat, said tray is in a tipped up position when said legs are in said closed position.

13. A highchair in accordance with claim 1, wherein:

said pedal means is positioned adjacent a hinged connection of said crosspiece to one of said first and second legs.

* * * * *